US005448845A

United States Patent [19]

Gibson

[11] Patent Number: 5,448,845

[45] Date of Patent: Sep. 12, 1995

[54] FRAME PIECE FOR DISPLAY HOLDER

[75] Inventor: Scott S. Gibson, Mercer Island, Wash.

[73] Assignee: Burke Gibson, Inc., Auburn, Wash.

[21] Appl. No.: 320,048

[22] Filed: Oct. 7, 1994

Related U.S. Application Data

[63] Continuation-in-part of Ser. No. 23,694, Feb. 26, 1993, Pat. No. 5,419,134.

[51] Int. Cl.[6] ..... G09F 7/00

[52] U.S. Cl. ..... 40/611; 40/155; 40/156

[58] Field of Search ..... 40/611, 617, 642, 649, 40/156, 155

[56] References Cited

U.S. PATENT DOCUMENTS

| | | | |
|---|---|---|---|
| 3,102,351 | 9/1963 | Howell | 40/611 |
| 3,425,147 | 2/1969 | Marx | 40/155 |
| 3,665,628 | 5/1972 | Dammond | 40/155 |
| 3,969,838 | 7/1976 | Moore | 40/611 |
| 4,282,667 | 8/1981 | Glade | 40/152 |
| 4,344,244 | 8/1982 | Tyke | 40/611 |
| 4,729,183 | 3/1988 | Tarter et al. | 40/642 |
| 4,805,331 | 2/1989 | Boggess et al. | 40/651 |
| 5,189,822 | 3/1993 | Schmanski et al. | 40/642 |

FOREIGN PATENT DOCUMENTS

| | | | |
|---|---|---|---|
| 2345115 | 10/1977 | France | 40/156 |

*Primary Examiner*—Edward K. Look
*Assistant Examiner*—James A. Larson
*Attorney, Agent, or Firm*—Glenn D. Bellamy; David P. Campbell

[57] ABSTRACT

An improved frame piece (300) for a display holder (334) including a pair of inner ridges (320) extending along the outer edges of center rails (316') of flanges (304, 306). Frame piece (300) works in conjunction with an elongated opening (326) in the upper region of center panel (324), wherein ridges (320) project into opening (326) to securely hold frame piece (300) to center panel (324).

9 Claims, 6 Drawing Sheets

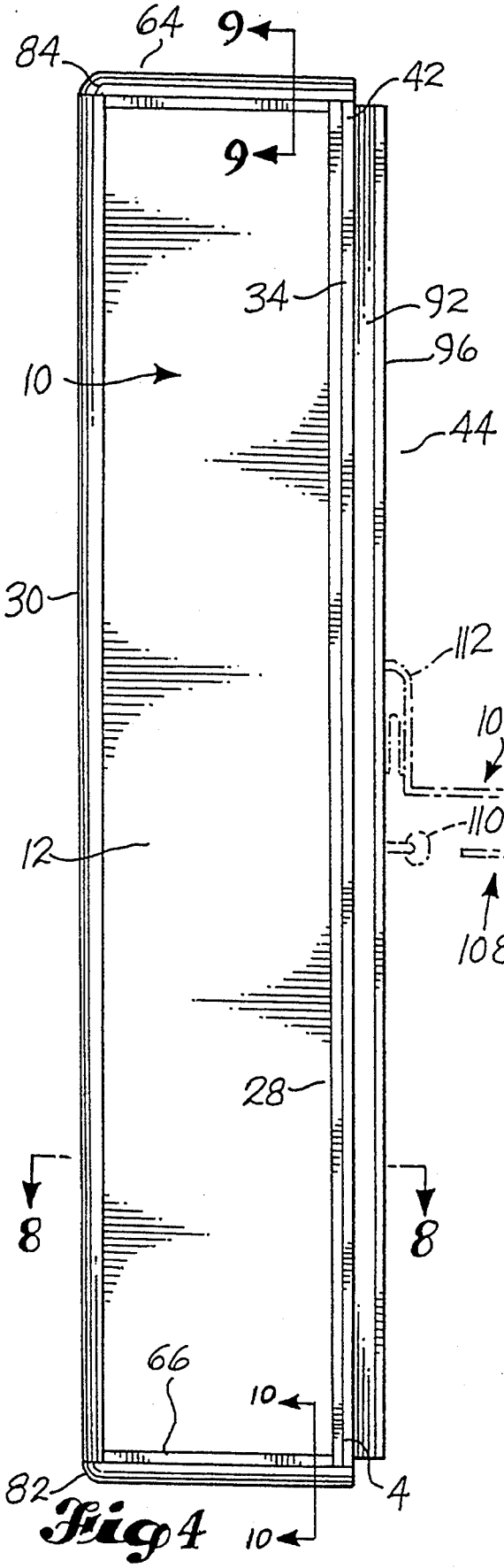
Fig. 4
Fig. 5
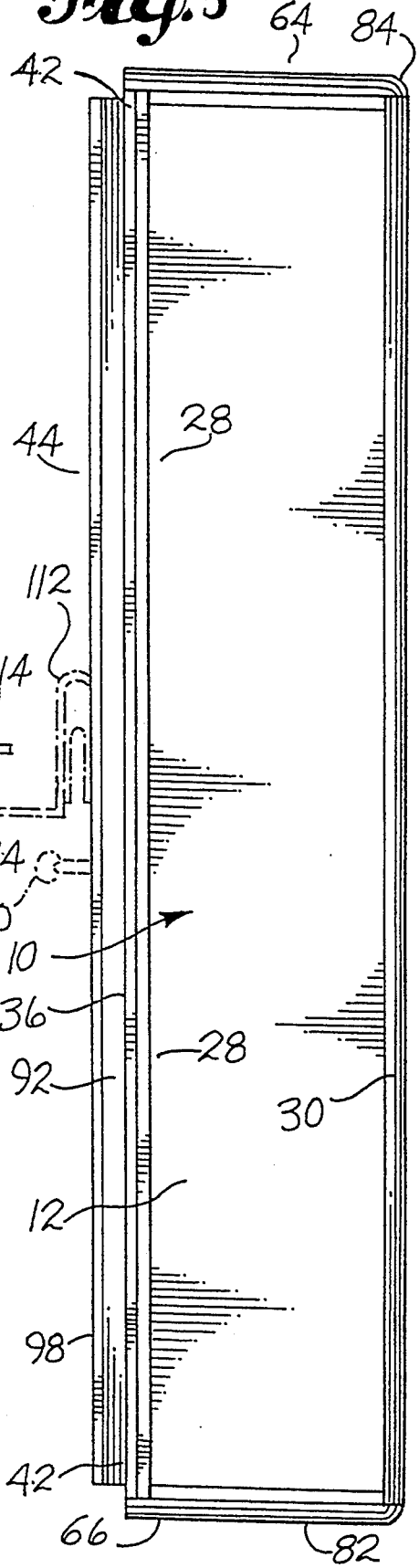

3/6
84
10
64
92
90
116
116
F
44
108
114

92
108
82
114
116
116
90
44
66

30
58
54
62
14
10
48
28
36
40
42
44
98
102
52
104
94
60
56
20
12
16
18
100
50
46
32
34
38
90
92
96
22
68
64
72
74
12
12

86
70
76
78
66

11
11
88
86
70
24
70

12
13
88
66
78
76
70
80
82
86
12
13

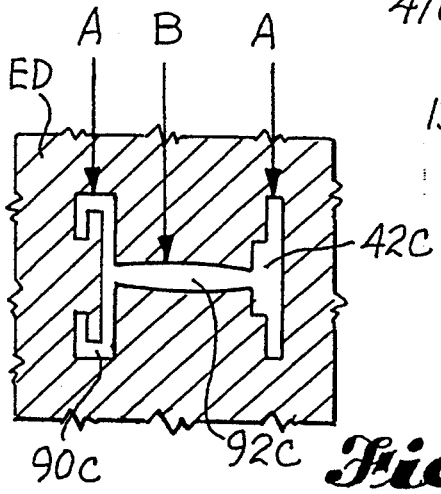
Fig. 14
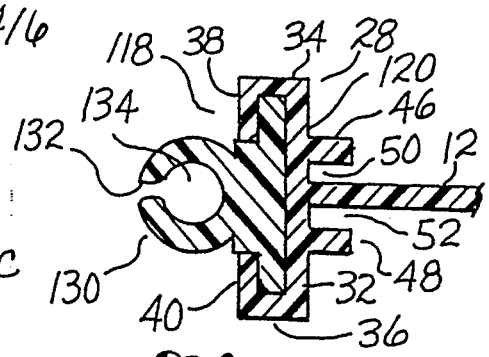
Fig. 16
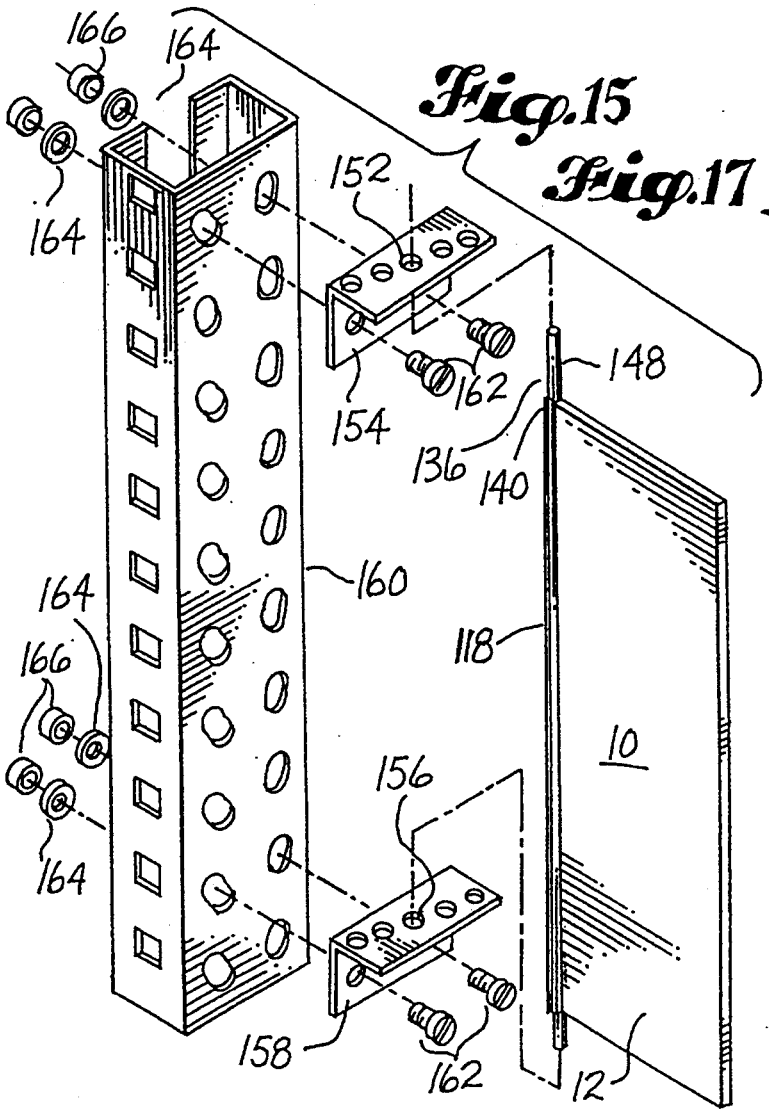
Fig. 15
Fig. 17
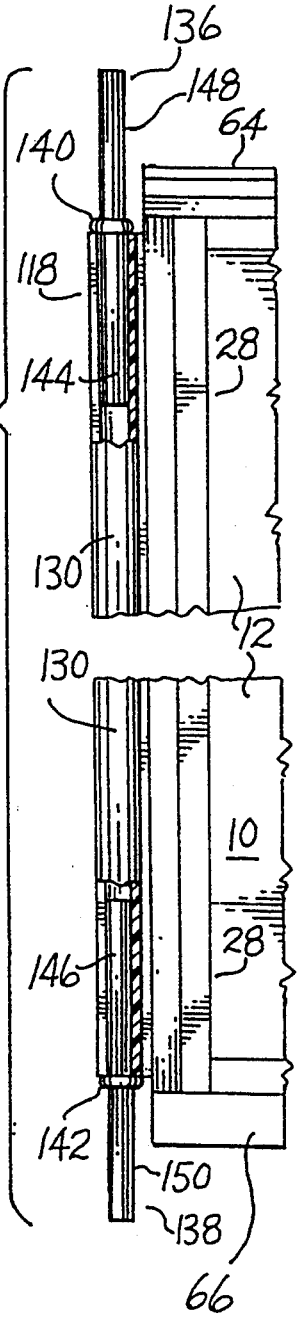

FRAME PIECE FOR DISPLAY HOLDER

RELATED APPLICATION

This is a continuation-in-part of my U.S. patent application, Ser. No. 08/023,694, filed Feb. 26, 1993, now U.S. Pat. No. 5,419,134.

TECHNICAL FIELD

This invention pertains to display holders of the type for displaying sign boards and, more particularly, to an improved frame piece for display holders for providing easy access to and replacement of sign boards, with a secure, yet removable, interlock between the frame piece and the display holder.

BACKGROUND INFORMATION

My patent application, Ser. No. 08/023,694, filed Feb. 26, 1993, and entitled "Display Holder," discloses a vertical display board having frame sections that frame the area of the sign board held by the display holder. Either the top frame section or the bottom frame section is removable from the display holder to gain access to the sign board. In use, the top frame section can be removed to insert a sign board into the display holder, and then replaced to frame out the sign. Replacement of the sign board is achieved in a similar manner.

The present invention is an improvement over the top frame section of my aforementioned U.S. patent application. The top frame section disclosed in my prior application was held to the display holder by a chemically-bonding cement, by friction and by gravity. The present invention improves upon this design to provide a positive, secure interlocking of the top frame section to the display holder.

DISCLOSURE OF THE INVENTION

Briefly described, the present invention comprises a display holder including a center panel and frame pieces around outer edges of the center panel for holding a display sign against the center panel. The center panel includes an elongated opening in its upper region. A top section of the frame pieces is separable from the center panel and includes a pair of spaced apart flanges forming a center panel receiving slot. The flanges include inwardly projecting ridges sized to fit into the elongated opening in the center panel. Upon placing the removable top frame piece section onto the center panel, the ridges are held in the center panel elongated opening and thereby secure the top frame section to the center panel.

According to an aspect of the invention, the ridges are provided at the outer edges of the flanges and the height of the flanges is approximately equal to the distance from the center panel opening to an outer edge of the center panel. In this manner, the ridges securely fasten the top frame section to the center panel without any slack between the two components.

According to another aspect of the invention, the top frame section includes an elongated opening extending along its length proximately aligned with the ridges and positioned between the flanges. This elongated opening is used in the injection molding process for manufacturing the ridges into the flanges.

Other features, advantages, and objects of the present invention will become apparent from the following detailed description of the invention, the accompanying drawings, and the claims, all of which are incorporated into the disclosure of the invention.

BRIEF DESCRIPTION OF THE DRAWINGS

Like reference numerals and letters are used to designate like parts throughout the several views of the drawing, and:

FIG. 4 is a first side elevational view of the display holder shown by FIGS. 1–3;

FIG. 5 is a second side elevational view of the display holder shown by FIGS. 1–4;

FIG. 14 is a sectional view through an extrusion die used for forming the mounting member by a co-extrusion process;

FIG. 15 is an exploded pictorial view of the display holder of FIGS. 1–7, shown with a modified mounting structure;

FIG. 16 is a transverse sectional view taken through the rear flange of the display holder and a mounting member adapted to mount the display holder in the manner shown by FIG. 15;

FIG. 17 is a fragmentary elevational view showing the upper and lower ends of the display holder and the mounting structure shown by FIG. 15;

BEST MODE FOR CARRYING OUT THE INVENTION

Figures 1, 2, 3:
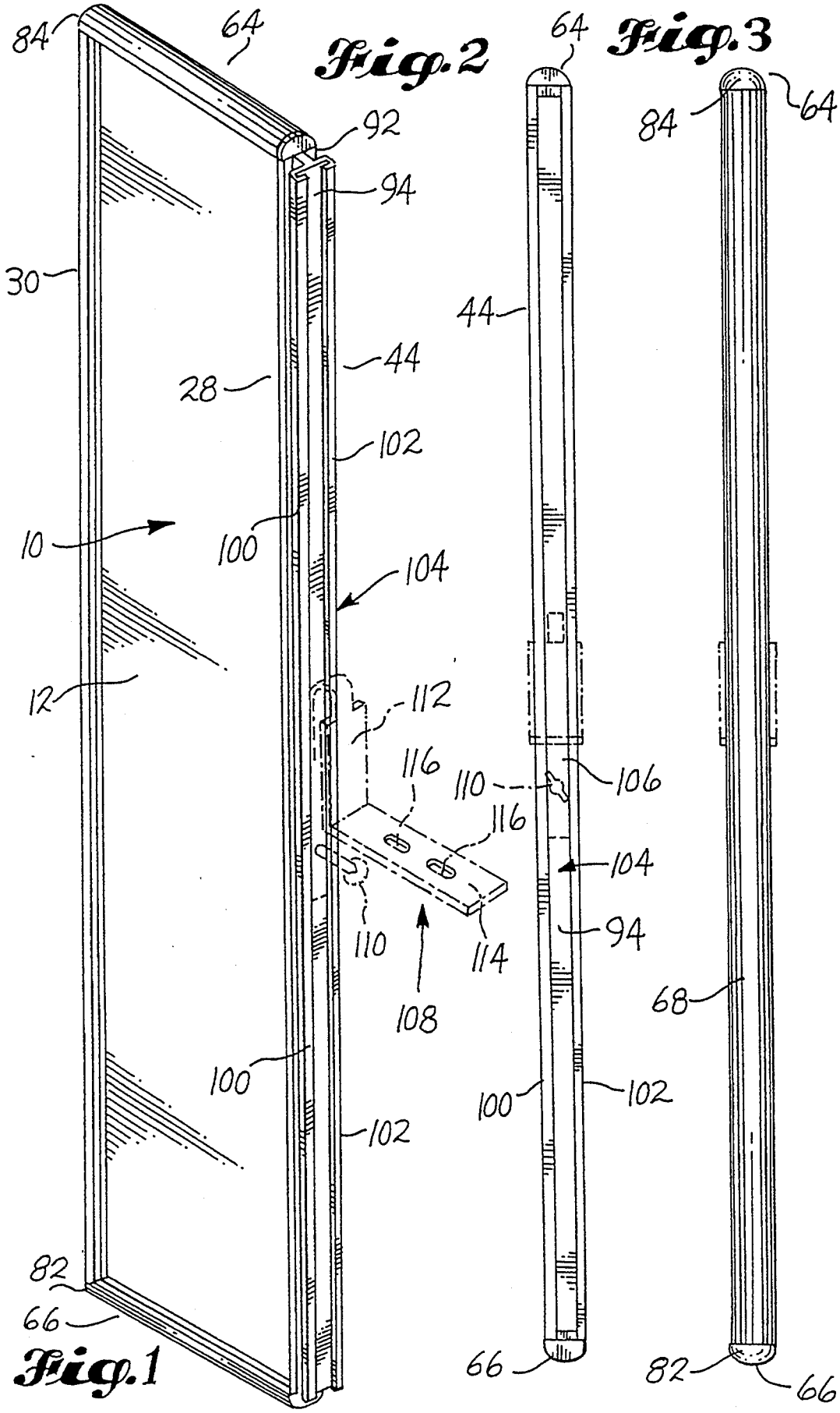
FIG. 1 is a pictorial view of a display holder incorporating the invention, shown in its upright position, and taken from above and towards the top, one side and the rear edge.
FIG. 2 is a rear edge elevation view of the display holder shown by FIG. 1.
FIG. 3 is a front edge elevational view of the display holder shown by FIGS. 1 and 2.

Referring to FIGS. 1–6, in preferred form, the display holder of the present invention comprises a main member 10 that is preferably an extrusion. The cross-sectional shape of this extrusion is shown by FIG. 8. Main member 10 includes a center panel 12 having a first side face 14 and a second side face 16. Center panel 12 also includes a first side edge 18, a second side edge 20, a third edge 22 at its top. (FIG. 9) and a fourth edge 24 at its bottom (FIG. 10). Edges 18, 20 are sometimes referred to as first and second opposite edges. This is because they are at opposite side edge boundaries of the center panel 12. Edges 22 and 24 are sometimes referred to as third and fourth opposite edges. This is because they are at opposite end boundaries of the center panel 12.

Referring back to FIG. 8, the extrusion which includes center panel 12 also includes first and second frame portions 28, 30. Frame portion 28 includes a base strip 32 which extends perpendicular to center panel 12. In preferred form, base strip 32 projects outwardly, an equal amount on each side of the center panel 12. A first flange 34 is connected to a first edge of base strip 32. A second flange 36 is connected to the second edge of base strip 32. The flanges 34, 36 are parallel to each other and both extend from the base strip 32 in a direction opposite from center panel 12. A first lip 38 is connected to flange 34. A second lip 40 is connected to flange 36. Lips 38, 40 are coplanar with each other and are in laterally spaced parallelism with base strip 32. Base strip 32, flanges 34, 36 and lips 38, 40 together form a lipped channel in which one flange 42 of a mounting member 44 is received. The lipped channel opens edgewise outwardly of the center panel 12. Frame portion 28 includes a pair of frame flanges 46, 48 which project from base strip 32, in a laterally spaced relationship with the center panel 12. Frame flanges 46, 48 extend parallel to each other and to the center panel 12. A channel 50 is formed by and between center panel 12 and frame flange 46. A channel 52 is formed by and between center panel 12 and frame flange 48.

Frame portion 30 comprises a cap strip 54 and a pair of frame flanges 56, 58. Cap strip 54 is generally semi-annular in cross-sectional shape. Frame flange 56 extends from cap strip 54 in a laterally spaced relationship with center panel 12. Frame flange 58 also extends from cap strip 54 in a laterally spaced relationship from center panel 12, but on the opposite side of the center panel 12 from frame flange 56. Frame flanges 56, 58 extend parallel to each other and to the center panel 12. A channel 60 is formed by and between center panel and frame flange 56. On the opposite side of the center panel 12, a channel 62 is formed by and between center panel 12 and frame flange 58.

Figures 6, 7, 8, 9, 10, 11, 12, 13:
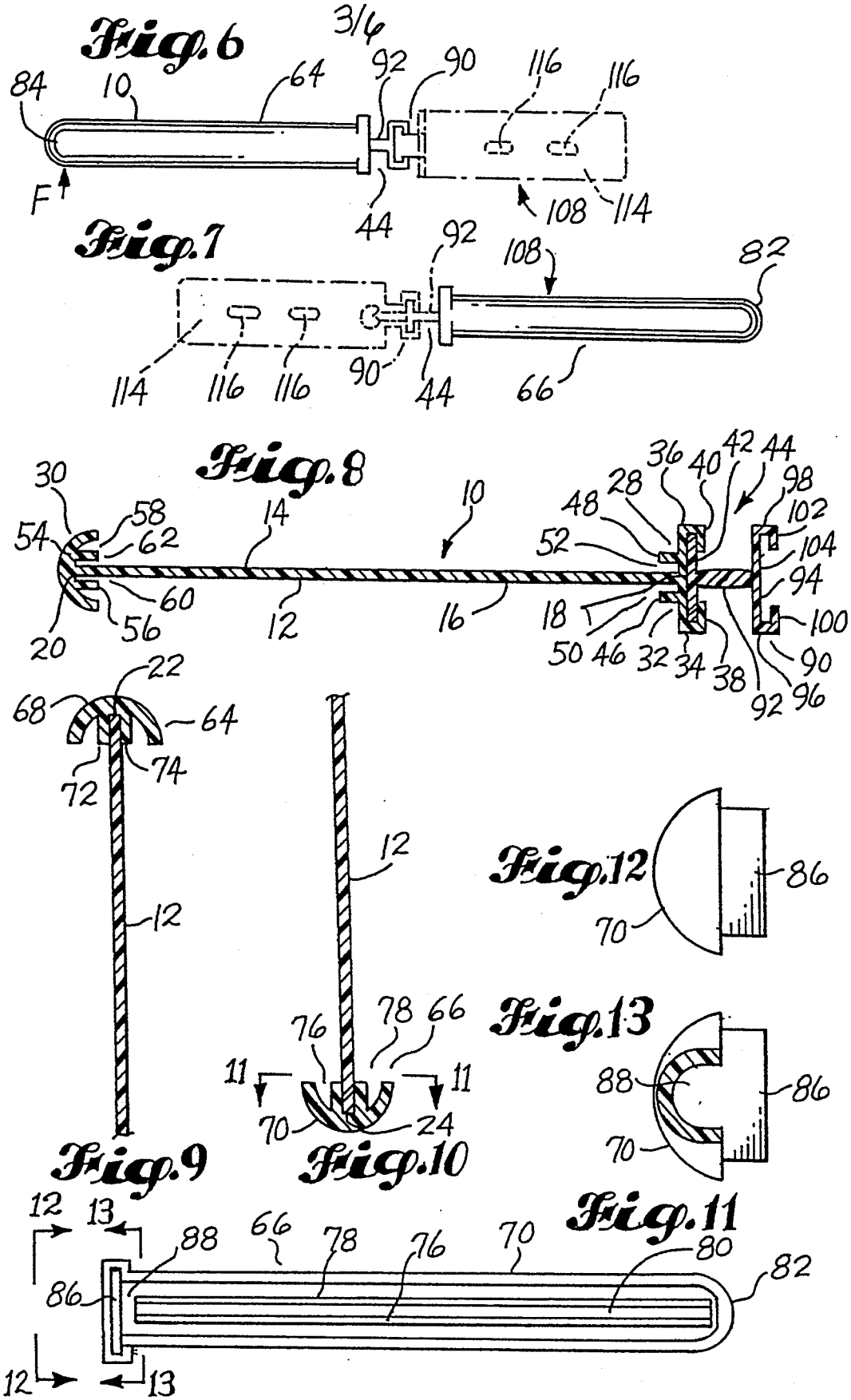
FIG. 6 is a top plan view of the display holder shown by FIGS. 1–5.
FIG. 7 is a bottom plan view of the display holder shown by FIGS. 1–6.
FIG. 8 is a transverse sectional view taken substantially along line 8—8 of FIG. 4.
FIG. 9 is a vertical sectional view taken substantially along line 9—9 of FIG. 4.
FIG. 10 is a vertical sectional view taken substantially along line 10—10 of FIG. 4.
FIG. 11 is a top plan view of the bottom end cap taken substantially from the position of line 11—11 of FIG. 10.
FIG. 12 is an end view of the end cap shown by FIG. 11, such view being taken generally from an aspect indicated by line 12—12 in FIG. 11.
FIG. 13 is a sectional view taken substantially along line 13—13 of FIG. 11.

As shown by FIG. 8, channel 60 confronts channel 50 on a first side of center panel 12. Channel. 62 confronts channel 52 on the opposite side of center panel 12. The channels 50, 60 and 52, 62 receive side edge portions of a article or articles to be displayed. For example, a plastic or cardboard sign board may be slid endwise of the display holder, with its opposite edge portions within channels 50, 60. A duplicate of this display board can be located in channels 52, 62 on the opposite side of display holder 10. Or, for example, a plurality of strips of wood, each bearing a different paint sample, can be slid into the channels 50, 60 and/or 52, 62.

Frame portions 64, 66 may be injection molded from a suitable structural plastic. As shown by FIGS. 9 and 10, frame portions 64, 66 comprise cap strips 68, 70 which are like cap strip 54, in cross-sectional configuration. However, they include flanges 72, 74 and 76, 78 which are parallel to each other and laterally spaced apart a distance substantially equal to the thickness of center panel 12. As shown by FIG. 9, the upper edge portion of center panel 12 is snugly fitted in a channel formed by and between flanges 72, 74. As shown by FIG. 10, a lower end portion of center panel 12 is snugly fitted within a channel formed by and between flanges 76, 78. FIG. 11 is a top plan view of frame portion 66. It is also a bottom plan view of frame portion 64 because frame portions 64, 66 are identical in construction. In FIG. 11, the channel in which the lower end portion of center panel 12 is received is designated 80.

As shown by FIG. 11, the end of frame portion 66 which meets the end of frame member 30, at a lower corner of the display holder, is rounded at 82. This rounded corner region is substantially in the shape of a quarter sphere. Frame portion 64 includes a like end region 84. Referring to FIG. 11, the opposite end of frame portion 66 includes a tongue 86 which extends downwardly into the lipped channel formed by base strip 32, flanges 34, 36 and lips 38, 40. It also includes a space 88 in which is received a central end portion of base strip 32, when frame portion 66 is connected to the lower edge portion of center panel 12. Mounting member 44 is shorter in length than base strip 32. The opposite ends of mounting member 44 are spaced endwise inwardly of frame portions 64, 66, to allow entry of the end portions of mounting strip 32 into the space 88 in frame portion 66, and into a like space in frame member 66. The end portions of center panel 12 are snugly received between the flanges 72, 74 at the top and 76, 78 at the bottom. In this manner, the frame portions 64, 66 are frictionally connected to the ends of the main member 10. As can be seen from the several drawing figures, when the frame portions 64, 66 are in place, they form end closures for the channels 50, 60 and 52, 62.

Mounting member 44 includes flange 42, a base flange 90 and a web 92. Base flange 90 includes a base wall 94 that is in spaced parallelism with flange 42. Wall 94 extends perpendicular to web 92. Flanges 96, 98 extend from wall 94 in a direction opposite web 92. Flanges 96, 98 are parallel to each other and are perpendicular to wall 94. Lips 100, 102 extend inwardly from flanges 96, 98. Lips 100, 102 are in coplanar parallelism. They are also in spaced parallelism with wall 94. Wall 94, flanges 96, 98 and lips 100, 108 together form a lipped channel 104 which extends the full length of the mounting member 44.

In accordance with an aspect of the invention, mounting member 44 is manufactured by a co-extrusion process. Referring to FIG. 14, die cavities 42*c*, 90*c*, 92*c* are formed in an extrusion die ED. A first structural plastic "A" is introduced into cavities 42*c* and 90*c* while a second plastic "B" is introduced into cavity 92*c*. The two plastics "A" and "B" bond together as they move through the die ED. Plastic "A" is a relatively strong and rigid structural plastic, e.g. rigid PVC. Plastic "B" is a strong but resilient plastic, e.g. resilient PVC. It is bendable but returns to its at rest shape when the bending force is removed from it. Referring to FIG. 6, for example, when a force "F" is applied against the display holder 10, it will cause the web 92, which also may be referred to as a "hinge strip", to bend. When force F is removed, the hinge strip 92 returns to its at rest position, shown in FIG. 8. Thus, hinge strip 96 is in the nature of a spring. It is bendable but as it bends it stores spring energy. When the bending force is removed, the spring energy moves the hinge strip 96 back into its at rest position. Preferably, the at rest position has the display holder 10 extending generally perpendicular to the member to which mounting flange 90 is connected.

As shown in FIGS. 1, 2 and 4–7, an elongated tongue portion 106 of a connector 108 may fit snugly within lipped channel 104. A set screw 110 may be threaded into a threaded opening in the tongue 106. Set screw 110 can be rotated clockwise to exert a locking force against wall 94 of lip channel 104. In this manner the set screw 110 holds the connector 108 firmly to the mounting member 44. Connector 108 extends upwardly and rearwardly from tongue 106 and then downwardly as a rear leg 112. It then extends horizontally as a mounting leg 114. The mounting leg 114 may be set down on a shelf and screw fasteners (not shown) may be inserted through openings 116 and used to firmly connect the connector 108 to the shelf. Of course, other methods of attaching the display holder 10 to a shelf or other support member may be employed.

FIGS. 15–17 relate to a modified embodiment of the invention in which the mounting member 44 is replaced by a different style of mounting member 118. Mounting member 118 has a uniformed cross section throughout its length (FIG. 16). It is equal in length to mounting member 44. Mounting member 118 includes a flange 120 that is like flange 42. Flange 120 fits snugly within the lipped channel in frame portion 28 formed by the base strip 32, the flanges 34, 36 and the lips 38, 40 (FIG. 16). Mounting member 118 also includes a slotted, tubular rib 130. Rib 130 is substantially annular in cross section but includes a slot 132 which extends the full length of rib 130. It also includes a center opening 134. Rib 130 provides a strong back bone for the mounting member 118. It also provides mounting sockets for a pair of trunnions 136, 138. Each trunnion 136, 138 includes an enlargement 140, 142 which divides it between inner and outer parts. Each inner part 144, 146 fits snugly within the opening 134 at one end of the rib 130. The enlargements 140, 142 fit against the end surface of the rib 130 and prevent movement of the trunnion 136, 138 into the opening 134 beyond the location of enlargement 140, 142. The outer or outboard portions 148, 150 of the trunnions 136, 138 each extend coaxial with the other. The outboard end portion 148 of trunnion 136 extends through an opening 152 in an upper mounting bracket 154. Specifically, opening 152 is in a horizontal leg of the bracket 154. The outboard end portion 150 of trunnion 138 fits within an opening 156 in a second bracket 158. As shown by FIG. 15, opening 156 is in a horizontal leg of bracket 158. Brackets 154, 156 are secured to a frame member 160, by fastener assemblies including bolts 162, washers 164 and nuts 166, as shown in FIG. 15.

The opening 134 is slightly smaller in diameter than the diameter of end parts 144, 146 of the trunnions 136, 138. Thus, it is necessary to force the end parts 144, 146 into the ends of the opening 134. This is permitted by the slot 132. It allows the side portions of the rib 130, on opposite sides of slot 132, to spread apart slightly as the trunnions are forced inwardly. This makes the side portions act as springs or clamps. They firmly grip and hold the end portions 144,146 of the trunnions 136,138. The lower enlargement 142 also acts as an end bearing, where it bears against the metal surrounding opening 156.

As shown in FIG. 15, the horizontal legs of the brackets 154, 158 may be provided with a plurality of laterally spaced apart openings. In the illustrated example, five openings are shown. This permits the mounting of five display holders 10, as a group, between the two brackets 154, 158. Other ways of mounting the display holder may be used. Also, the configuration of the display holder may vary from what is illustrated.

The corners 82, 84 are rounded and the frame portions 30, 64, 66 are rounded in the lateral direction. This provides a surface which is not apt to cause any injury if struck by a person or any damage to an object that may be accidently moved in contact with the display holder 10. The illustrated display holders are vertically elongated. However, certain aspects of the invention could be used with advantage within a display holder that is horizontally elongated. For example, the construction of the display holder from a single extrusion main member, including a center panel and opposite edge frame portions, together with detachable frame members for the other pair of opposite edges.

Figure 18:
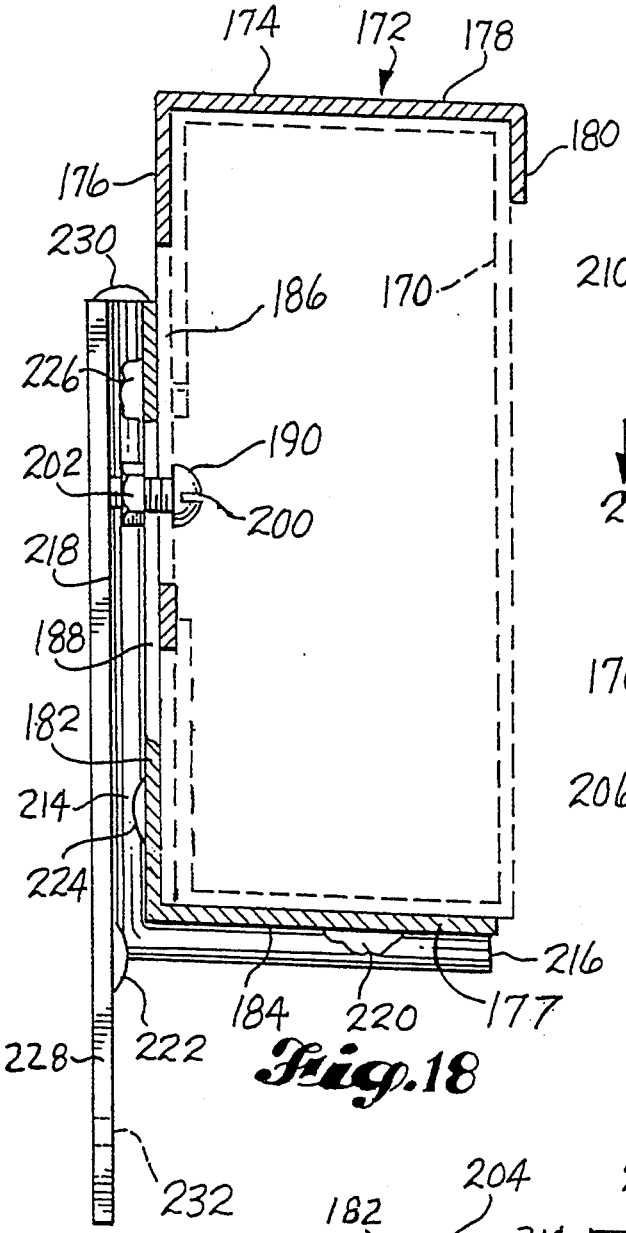
FIG. 18 is a vertical sectional view taken substantially along line 18—18 of FIG. 19, showing a mounting bracket that may be used for connecting the display holder to a horizontal beam, such view showing a beam in phantom lines.
Figure 19:
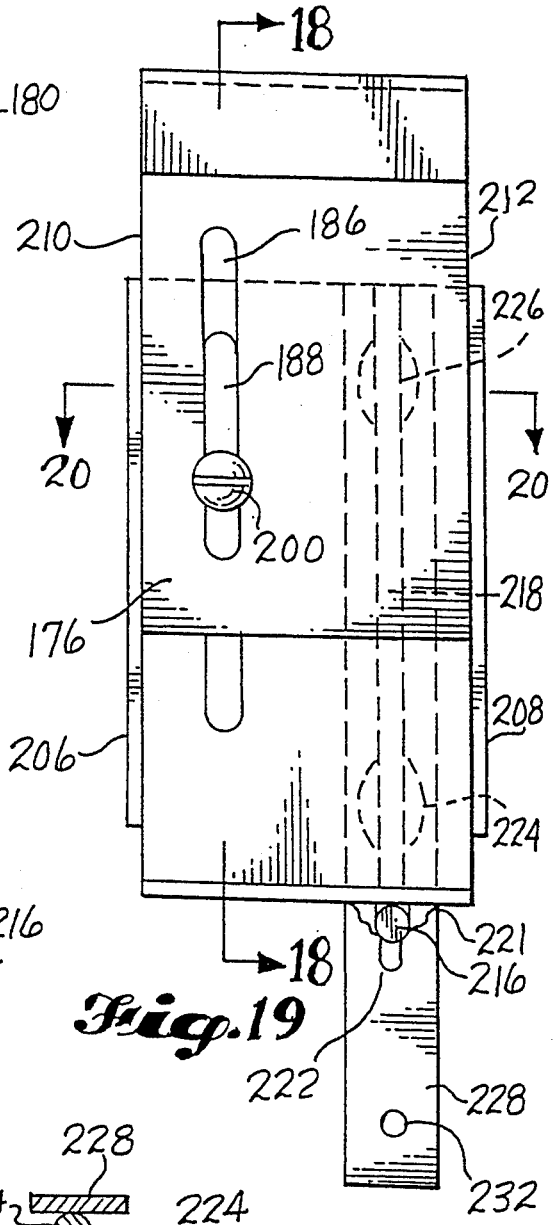
FIG. 19 is an elevational view looking towards the left side of FIG. 18.
Figure 20:
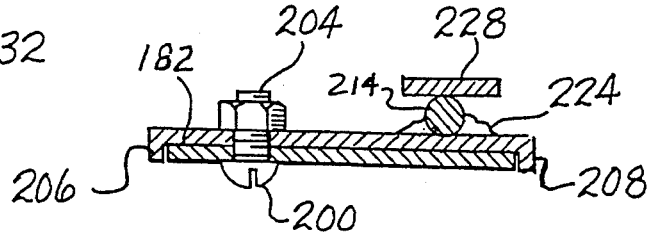
FIG. 20 is a sectional view taken substantially along line 20—20 of FIG. 19.

FIGS. 18–20 illustrate the mounting bracket that may be used for securing the first embodiment (FIGS. 1–13) to a horizontal frame member or beam 170. Beam 170 may be like frame member 160 shown in FIG. 15. The mounting bracket 172 would be used in place of the connector 108. Mounting bracket 172 comprises a first part 174 and a second part 177. Part 174 has a vertical wall 176, a top wall 178 and a flange 180. Flange 180 depends from top wall 178 and is parallel to wall 176. The second part 177 includes a vertical wall 182 and a bottom wall 184. Walls 182, 184 are perpendicular to each other. Walls 176, 178 are perpendicular to each other and flange 180 is perpendicular to wall 178. As illustrated, wall 176 side laps wall 182. Wall 176 includes a vertical slot 186 and wall 182 includes a vertical slot 188. Each slot 186, 188 is closed at both of its ends. Slots 186, 188 are in alignment with each other, as best shown by FIG. 19. A screw fastener 190 extends through the two slots 186, 188. Screw fastener 190 includes a head 200 that is larger in diameter than the slots 186, 188 are wide. Screw 190 threads into a nut 202. The screw fastener 190 is screwed tight into the nut 202 so that it clamps the two members 176, 182 together. The provision of the slots 186, 188 and the screw fastener 190 permits adjustment of the mounting bracket 172 to different depth beams. Member 182 may include a pair of side flanges 206, 208 between which the vertical leg of member 176 is received. Flanges 206, 208 contact the opposite edges 210, 212 of vertical wall 176, to prevent bracket 172 from rotating in position relative to member 177, about the axis of the fastener screw 190. A spacer rod 214 is secured to the member 177. Rod 214 includes a horizontal leg 216 and a vertical leg 218. These legs 216, 218 are spot welded to member 177, at 220, 224 and 226. A flat bar 228 is welded to rod parts 216, 218 at 222 and 230. Flat bar 228 forms a flange that is sized and shaped to fit snugly within the lipped channel 104, in place of tongue 106. Bar 228 includes a threaded opening 232 which receives a set screw, like set screw 110. This set screw is used to firmly anchor the bar 228 in position relative to channel member 90 of mounting member 44.

Parts 174, 177 are brought together about the beam 170. Then, the screw fastener 190 is tightened within nut 202, to firmly clamp members 174, 177 together. The square nature of the four corners of beam 170, the two corners of member 174 and the lower left (as pictured) corner of member 177 result in bracket 172 being firmly secured to the beam 170, and restrained against movement in essentially all directions. This clamping of the members 174, 177 together, and to the beam 170, provides a definite vertical placement of the member 228. Bar portion 218 provides a proper lateral spacing of flat bar 228 from vertical walls 176, 182. Member 218 is also sized to fit within the open region of the channel 104, between the two lips 100, 102.

Figure 21:
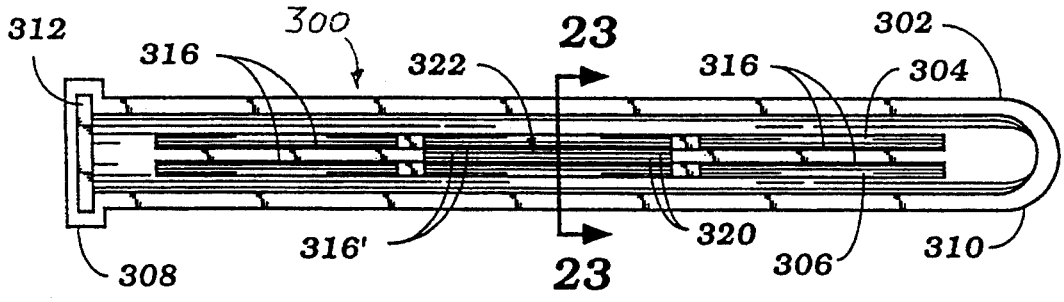
FIG. 21 is an underside view of an alternative embodiment for the top cap strip or frame portion shown in FIG. 11.
Figure 22:
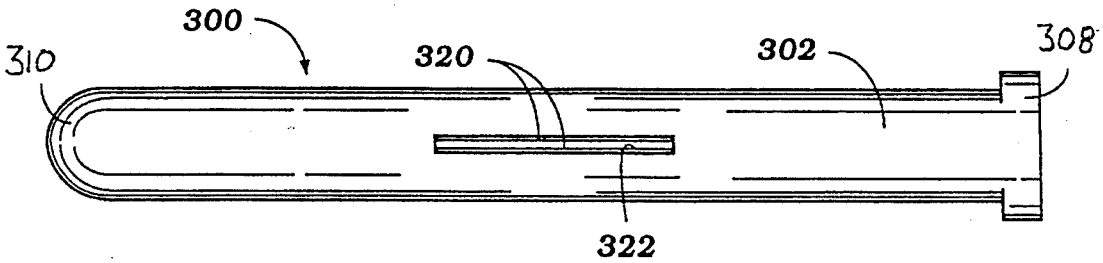
FIG. 22 is a top plan view of the cap strip of FIG. 21.
Figure 23:
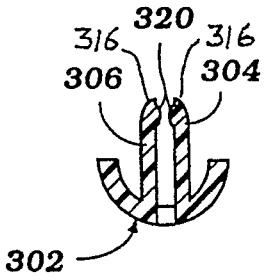
FIG. 23 is a sectional view taken along the line 23—23 of FIG. 21.

FIGS. 21–25 illustrate an alternative embodiment for a top frame piece 300. As shown in FIGS. 21, 22, and 23, frame piece 300 is substantially the same as frame piece 64 of FIGS. 4 and 5, and includes a curved cap strip 302, a pair of upstanding parallel flanges 304, 306, a rectangular end 308, and a rounded end 310. Rectangular end 308 includes a short projecting tongue 312, similar to tongue 86 of FIG. 11.

Flanges 304, 306 include aligned rails 316 along their outer edges. The center rails 316' include inner projections or ridges 320, which project toward one another and narrow the gap at the outer edges of flanges 304, 306. Flanges 304, 306 are spaced apart a distance approximately equal to the thickness of the center panel of the display holder. Ridges 320 reduce the spacing between flanges 304, 306 for purpose of interlocking frame piece 300 to the center panel of the display.

Cap strip 302 includes an elongated slot-like opening 322, which is aligned longitudinally with center flanges 316'. Opening 322 is formed by a plated projection used in the injection mold process for manufacturing frame piece 300. The plated projection is necessary for the formation of ridges 320. Once flanges 304, 306 and ridges 320 are formed, opening 322 serves no purpose.

Figure 25:
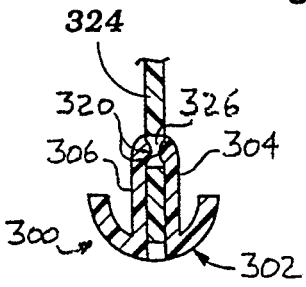
FIG. 25 is a partial schematic diagram showing an interconnection between the cap piece of FIG. 21 and the center panel of FIG. 24.
Figure 24:
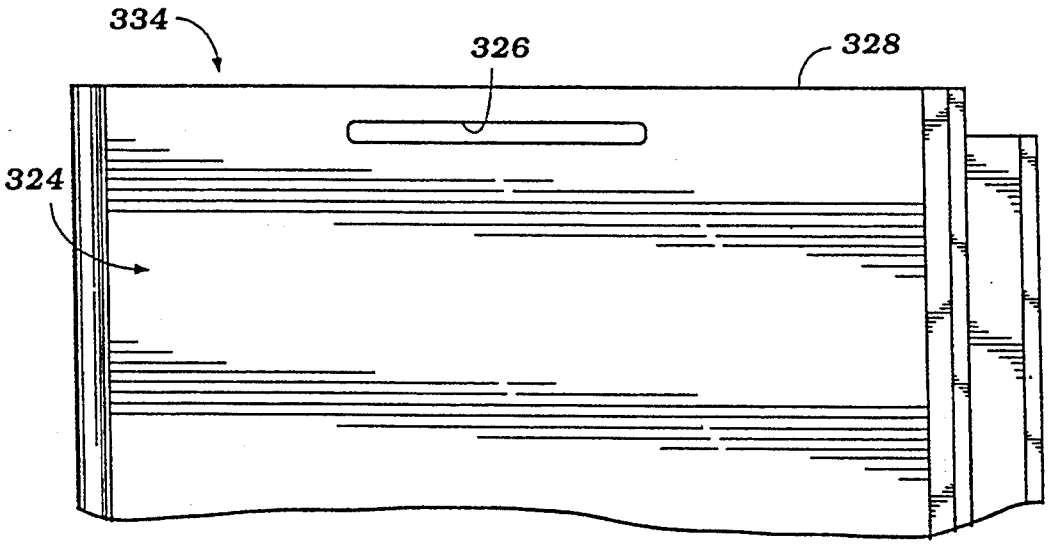
FIG. 24 is a partial side view of an alternative embodiment for the top portion of the center panel shown in FIGS. 4,5, which operates in conjunction with the cap piece of FIG. 21.

In FIG. 24, center panel 324 is shown slightly modified from center panel 12 of FIG. 1. The upper region of center panel 324 includes an elongated opening 326, which is aligned with the top edge 328 of center panel 324. As shown in FIG. 25, opening 326 receives ridges 320 to securely hold frame piece 300 to center panel 324. Frame piece 300 preferably is made of a material having sufficient flexibility to allow flanges 304, 306 to flex away from one another as frame piece 300 is snap-fitted onto top edge 328 of center panel 324. Ridges 320 should be rounded or smooth enough to minimize the effort necessary to pull frame piece 300 off of center panel 324. Ridges 320 and opening 326 act as a detent means for releasibly securing frame piece 300 to center panel 324.

The height of flanges 304, 306 from their base at cap strip 302 up to ridges 320 approximately is equal to the distance between opening 326 and edge 328 in center panel 324. With frame piece 300 snap-fitted onto center panel 324, there is no slack between the two components because ridges 320 securely hold center panel 324 between flanges 304, 306.

The alternative embodiment shown for frame piece 300 and center panel 324 provides a secure interlocking connection between the two components, yet allows for easy removal of frame piece 300 so that the sign board held by the display holder can be changed, cleaned, modified, or otherwise removed from the display holder.

The scope of protection is not to be limited by the illustrated examples. Rather, it is to be determined by a construction of the patent claims which follows, in accordance with established rules of patent claim construction, including use of the doctrine of equivalents.

What is claimed is:

1. A display holder, comprising:

a center panel, frame pieces around edges of the center panel for holding a display against the center panel, wherein the center panel includes an opening, and a section of the frame pieces is separable from the center panel and includes a pair of spaced apart flanges forming a center panel receiving slot, and wherein the flanges include inwardly projecting ridges, so that upon placing the removable section of frame piece onto the center panel, the ridges are biased into the center panel opening and secure the removable section of frame piece to the center panel.

2. The display holder of claim 1, wherein the ridges are provided at the outer edges of the flanges and the height of the flanges is approximately equal to the distance from the center panel opening to an outer edge of the center panel.

3. The display holder of claim 1, wherein the removable section of frame piece includes an elongated opening extending along its length proximately aligned with the ridges and positioned between the flanges.

4. The display holder of claim 1, wherein the removable section of frame piece forms a top frame section of the display holder, and the center panel opening is formed in the upper region of the center panel in close proximity to an upper edge of the center panel.

5. A vertically elongated display holder, comprising:

a center panel having two side faces, two side edges, a top edge and a bottom edge;

a first frame piece at the first side edge;

a second frame piece at the second side edge;

a third frame piece at the top edge;

a fourth frame piece at the bottom edge;

the first and second frame pieces forming with the center panel a pair of vertically extending channels at the first and second side edges of the center panel, for receiving mounting pieces of a display;

at least one of the third and fourth frame pieces being removable to permit insertion of a display into or removal of a display out from the channels;

the removable third or fourth frame piece including a pair of spaced apart flanges having inwardly projecting ridges, and the center panel including an opening for receiving the ridges, whereby the ridges are biased into the opening in the center panel upon placing the removable frame piece onto the edge of the center panel with the edge received between the flanges.

6. The display holder of claim 5, wherein the height of the flanges approximately equals the distance between the center panel opening and the edge of the center panel.

7. A display holder, comprising:

a center panel, frame pieces around edges of the center panel for holding a display against the outer surface of the center panel, wherein a section of the frame pieces is separable from the center panel and includes a pair of spaced apart flanges forming a center panel receiving slot, and detent means for securing the flanges of the separable frame piece to the center panel, yet providing for removal of the separable frame piece to gain access to the display.

8. The display holder of claim 7, wherein the detent means includes projections on the flanges and a recess in the center panel.

9. The display holder of claim 8, wherein the flanges have sufficient flexibility to bend and allow passage of the projections on the flanges around the center panel and into the recess of the center panel.

* * * * *